US006287243B1

(12) United States Patent
Isom et al.

(10) Patent No.: US 6,287,243 B1
(45) Date of Patent: Sep. 11, 2001

(54) MULTI-ADJUSTABLE EXERCISE BENCH

(75) Inventors: Larry H. Isom, Paso Robles; Bret A. Tolles, Cayucos, both of CA (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/253,865

(22) Filed: Feb. 22, 1999

(51) Int. Cl.[7] ..... A63B 21/00
(52) U.S. Cl. ..... 482/142; 482/130; 482/104
(58) Field of Search ..... 482/130, 142–144, 482/104, 106, 908, 133–138; 5/136, 167, 133, 178; 297/354, 13, 372

(56) References Cited

U.S. PATENT DOCUMENTS

| | | | | |
|---|---|---|---|---|
| 4,653,751 | * | 3/1987 | Green | 482/142 |
| 5,069,447 | * | 12/1991 | Snyderman | 482/142 |
| 5,429,570 | * | 7/1995 | Beyer | 482/104 |
| 5,462,510 | | 10/1995 | Ish, III . | |
| 5,882,283 | * | 3/1999 | Stevens | 482/104 |
| 5,921,897 | * | 7/1999 | Stevens | 482/104 |

OTHER PUBLICATIONS

Photograph—CYBEX 5440 Adjustable Incline Bench.
Photograph—CYBEX 5435 Adjustable Flat–To–80° Bench.
Photograph—CadEx B200 Multi–purpose bench.
Photograph—Paramount PFW 6200 Flat/Incline Bench.
Photograph—Body Masters B117 Multi–Purpose Incline/Flat Bench.

* cited by examiner

*Primary Examiner*—Jerome W. Donnelly
(74) *Attorney, Agent, or Firm*—David M. Thimmig; Mayer, Borwn & Platt

(57) ABSTRACT

A multi-adjustable exercise bench having a frame assembly, a back rest pivotally connected to the frame assembly, and a bottom rest pivotally connected at a first pivot to the back rest at a location spaced apart from the pivotal connection of the back rest to the frame assembly and pivotally connected at a second pivot to the frame assembly. Adjustment of the frame assembly to move the back rest from a first angle to a second angle relative to a bench supporting surface automatically moves the bottom rest from a first angle to a second angle relative to the back rest.

37 Claims, 4 Drawing Sheets

FIG. 2
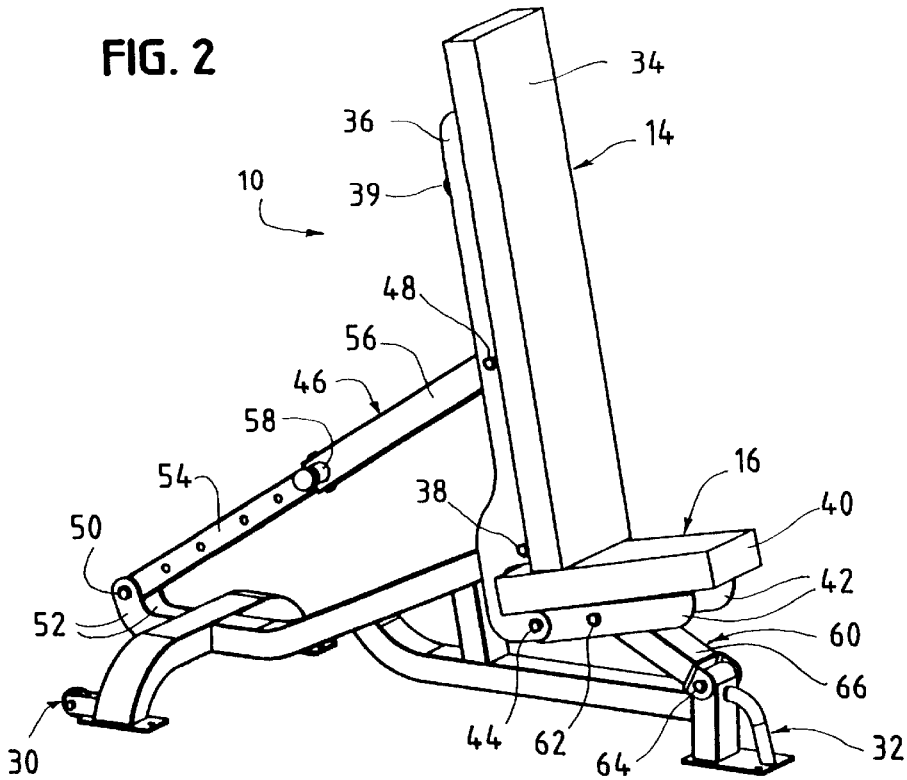
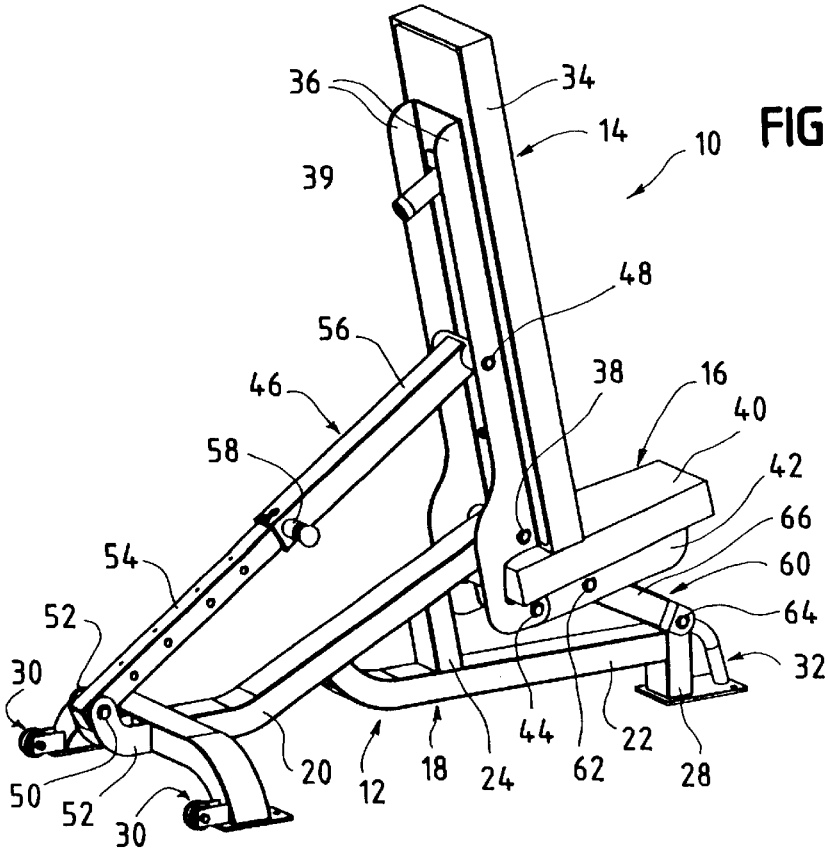
FIG. 3

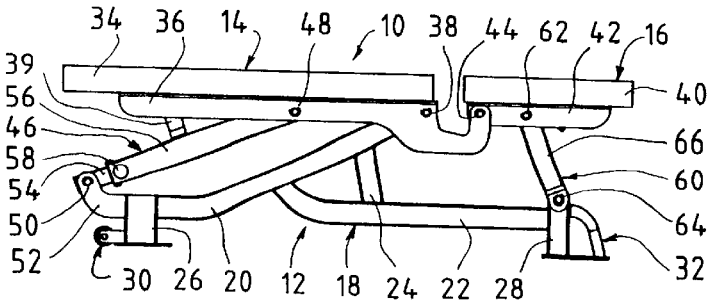
FIG. 4A
FIG. 4B
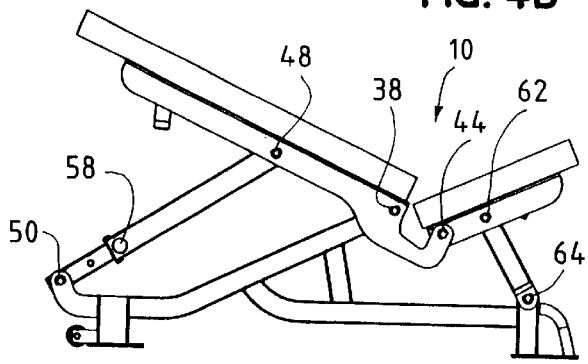
FIG. 4C
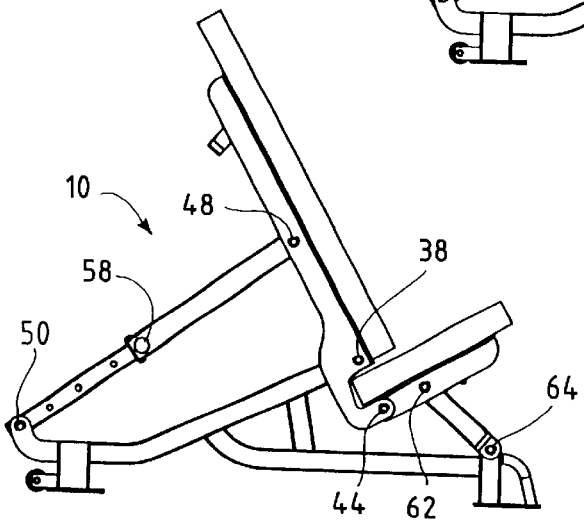
FIG. 4D
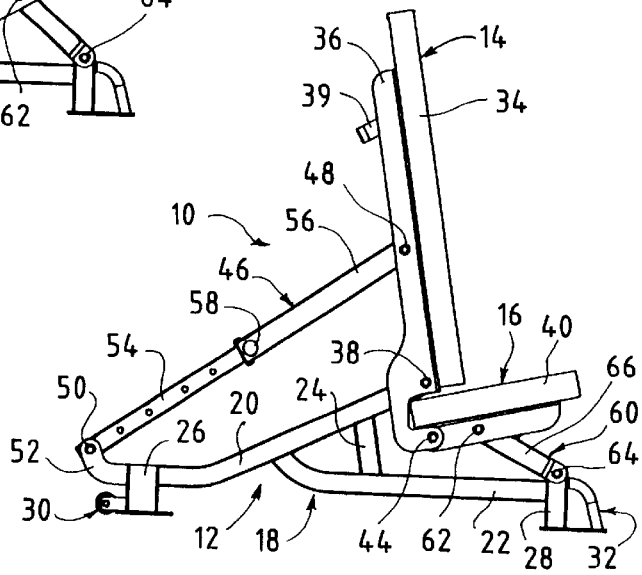

MULTI-ADJUSTABLE EXERCISE BENCH

BACKGROUND OF THE INVENTION

1. Field of the Invention

The present invention generally relates to exercise benches, and more particularly to a multi-adjustable exercise bench wherein adjustment of the back rest angle relative to a bench supporting surface also automatically adjusts the bottom rest to an appropriate corresponding angle. The adjustable exercise bench of the present invention includes a frame assembly, a back rest pivotally connected to the frame assembly, and a bottom rest pivotally connected at a first pivot to the back rest and at a second pivot to the frame assembly.

2. Discussion of the Prior Art

Exercise benches are commonly used in athletic facilities and homes to enable the performance of a variety of exercises, often involving weight training. Depending on the desired use, an individual may need a fixed horizontal bench or a bench capable of providing various back rest angles relative to the surface on which the bench is supported. Manufacturers have provided fixed horizontal benches, benches with an adjustable back rest, and benches with an adjustable back rest and separately adjustable bottom rest. Benches of these types have significant drawbacks. For example, a bench which remains horizontal relative to the bench supporting surface, such as a floor, limits the variety of exercises the user may perform. A bench having only an adjustable back rest does not provide a sound foundation for the user because the user tends to slide forward on the horizontal bottom rest while performing exercises. A bench with a separately adjustable back rest and bottom rest theoretically can provide appropriate back rest and corresponding bottom rest angles. However, this latter type of bench is inconvenient due to the multiple adjustment mechanisms needed to try to optimize the angle of the bottom rest relative to the back rest. Moreover, this type of bench requires the user to have knowledge of the appropriate settings to achieve proper angular adjustments. In addition, this type of prior art bench tends to have a common pivot axis on the frame for both the back rest and bottom rest. A common pivot for both the back rest and bottom rest is disadvantageous because the bottom rest should ideally be moved lower toward the bench supporting surface when the back rest is in more upright positions. The common pivot typically requires the leading edge of the bottom rest to be moved upward to tilt the bottom rest. This tends to force apart the legs of the user and tends to increase lower back hyperextension.

More recently, U.S. Pat. No. 5,462,510 disclosed an exercise bench having a relatively complicated structure wherein adjustment of the angle of the back rest simultaneously provides limited adjustment of the angle of the bottom rest relative to the bench supporting surface. This patent discloses multiple back rest positions, yet the bottom rest only attains a horizontal position (relative to the floor) and two other angled positions. Thus, the appropriate bottom rest position is not attained for each respective back rest angle. Moreover, when the bottom rest is tilted toward the back rest, a significant portion of the bottom rest rises, moving further away from the bench supporting surface. Hence the user experiences the same disadvantages of the earlier prior art, such as forcing apart of the legs and tendency to increase lower back hyperextension.

In light of the shortcomings of prior art exercise benches, it is desirable to have a relatively simple adjustable exercise bench which can be placed in a horizontal position and which also can provide multiple back rest angles and multiple bottom rest angles. It is further desirable that such an exercise bench have a single adjustment mechanism which adjusts the back rest angle and simultaneously automatically adjusts the bottom rest to an appropriate corresponding angle. It is also advantageous to have the bottom rest move downward toward the bench supporting surface as the back rest is moved to more upright positions. It is still further advantageous to have the bottom rest have a greater angle relative to the bench supporting surface when the back rest is in intermediate positions between horizontal and the most upright position. The present invention overcomes the disadvantages of the prior art, while providing the above mentioned desirable features of a multi-adjustable exercise bench.

SUMMARY OF THE INVENTION

The purpose and advantages of the invention will be set forth in and apparent from the description and drawings that follow, as well as will be learned by practice of the invention disclosed and claimed herein.

The present invention is generally embodied in an improved multi-adjustable exercise bench. The multi-adjustable exercise bench comprises a frame assembly, a back rest pivotally connected to the frame assembly, and a bottom rest pivotally connected at a first pivot to the back rest at a location spaced apart from the pivotal connection of the back rest to the frame assembly and pivotally connected at a second pivot to the frame assembly. Adjustment of the frame assembly to move the back rest from a first angle to a second angle relative to a bench supporting surface automatically moves the bottom rest from a first angle to a second angle relative to the back rest.

In a further aspect of the invention, the frame assembly has a base frame, a first strut and a second strut. The first strut has a first end connected to the back rest and a second end connected to the base frame. The second strut has a first end connected to the bottom rest and a second end connected to the base frame.

In another aspect of the invention, the bottom rest has a first end and a second end. The bottom rest is pivotally connected to the back rest proximate the first end of the bottom rest. Also, the first end of the bottom rest moves closer to the bench supporting surface as the angle of the back rest to the bench supporting surface is increased.

In yet another aspect of the invention, the multi-adjustable exercise bench comprises a frame, a back rest pivotally connected to the frame, and a bottom rest pivotally connected to the back rest. The bench has a first strut having first end pivotally connected to the frame and a second end pivotally connected to the back rest. The bench also has a second strut having a first end pivotally connected to the frame and a second end pivotally connected to the bottom rest.

In still another aspect of the invention, the multi-adjustable exercise bench comprises a frame, a back rest pivotally connected to the frame, and a bottom rest pivotally connected to the back rest at a location spaced apart from the pivotal connection of the back rest to the frame. The bench has a first strut having a first end connected to the frame and a second end connected to the back rest. The first strut is adapted to support the back rest in a plurality of different positions which are defined by the angle of the back rest relative to the bench supporting surface. The bench also has a second strut having a first end pivotally connected to the frame and a second end pivotally connected to the bottom rest. Movement of the back rest between the positions automatically adjusts the angle of the back rest and the angle of the bottom rest relative to the bench supporting surface.

BRIEF DESCRIPTION OF THE DRAWINGS

In describing the preferred embodiment, reference is made to the accompanying drawings wherein like parts have like reference numerals, and wherein:

FIG. 2 is a front perspective view of a multi-adjustable exercise bench of the present invention with the back rest in the most upright position.

FIG. 3 is a rear perspective view of a multi-adjustable exercise bench of the present invention with the back rest in the most upright position.

FIG. 4 is a series of side views (FIGS. 4A through 4D) of the adjustable exercise bench of the present invention illustrating the bench in a horizontal position (FIG. 4A), as well as in a few positions having the back rest at progressively greater angles to the bench supporting surface and with appropriate corresponding angles of the bottom rest (FIGS. 4B through 4D, respectively).

It should be understood that the drawings are not to scale. While considerable mechanical details of a multi-adjustable bench, including details of fastening mechanisms and other plan and section views of the particular embodiment depicting the invention have been omitted, such details are not considered necessary to a full and complete understanding of the invention disclosed and claimed herein. It should also be understood that the present invention is not limited to the preferred embodiment illustrated.

DESCRIPTION OF THE PREFERRED EMBODIMENT

Figure 1:
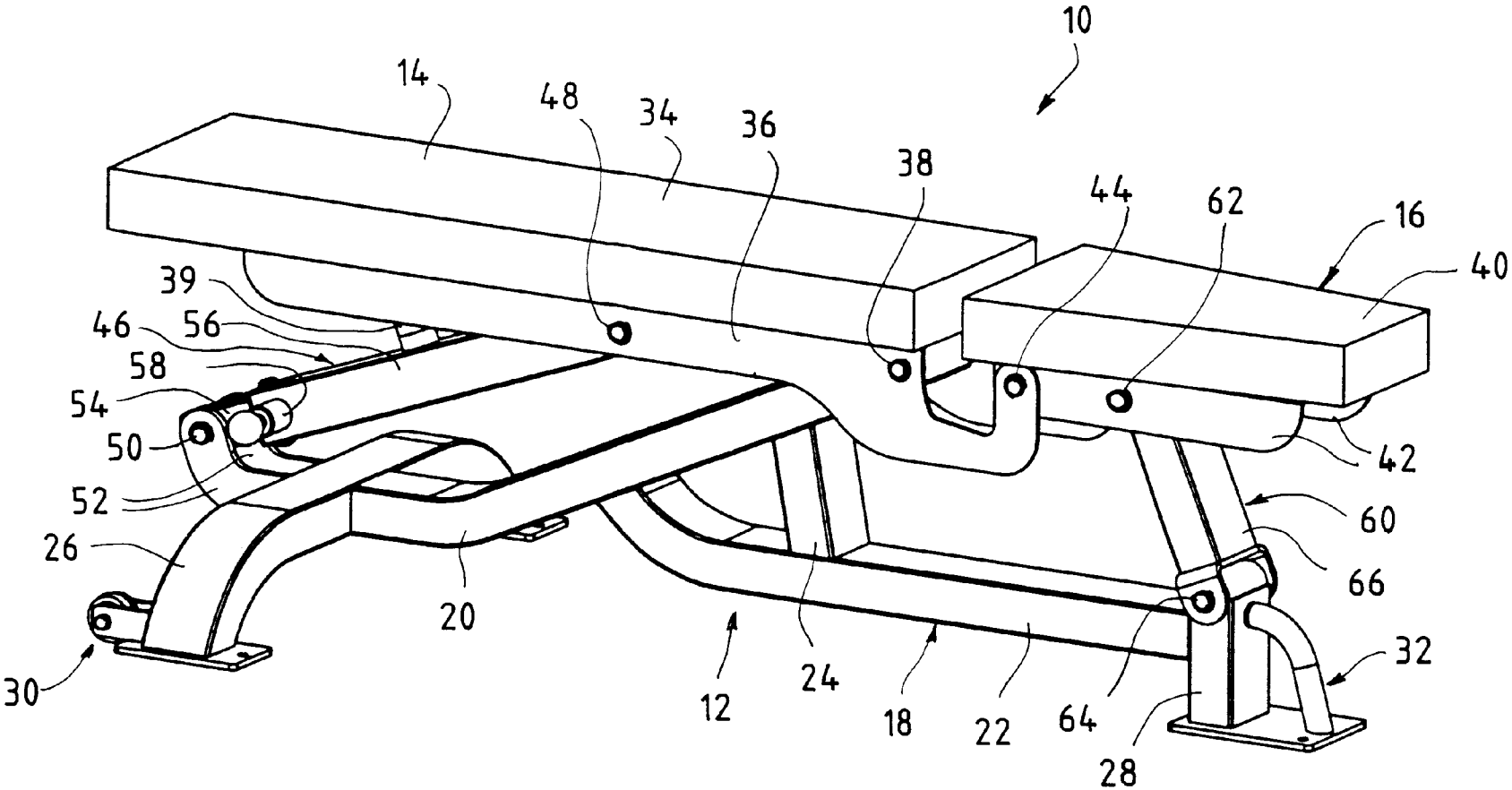
FIG. 1 is a perspective view of a multi-adjustable exercise bench of the present invention with the back rest and bottom rest in a horizontal position.

Referring now to FIGS. 1–3, the present invention is generally embodied in a multi-adjustable exercise bench 10. The bench 10 includes a frame assembly 12, a back rest 14, and a bottom rest 16. The frame assembly 12 is constructed of a number of bent and/or connected components, such as metal components to provide the structural integrity necessary in a weight training environment. The components are suitably joined as by welding or fasteners in a manner consistent with the practice in the industry, such as axles and spring clips or bolts and nuts for the various pivotal mountings.

More particularly, in the preferred embodiment, the frame assembly 12 has a base frame 18 including fixedly joined longitudinal members 20 and 22 and brace 24. The base frame 18 also has support members 26 and 28 to contact a bench supporting surface, such as a floor. Bench 10 may be accessorized for ease of transport, for example by attachment of wheel assemblies 30 to support member 26 and by attachment of a handle assembly 32 to support member 28.

As best shown in FIGS. 1–3, back rest 14 further comprises a back support such as back pad 34 and spaced apart support members 36 to which pad 34 is attached. Back pad 34 is preferably of urethane foam construction with a rigid wood backing board and a vinyl cover, although other suitable materials may be used. As best seen in FIG. 3, spaced apart support members 36 are preferably of integral construction. However, one skilled in the art will appreciate that the support members 36 could be individually attached to the back pad 34 and of a different configuration. Back rest 14 also is pivotally connected to frame assembly 12 at pivot 38 proximate the end of longitudinal member 20 of base frame 18. Back rest 14 may include a stop post 39 to provide additional rigidity when the back rest 14 is in the horizontal position.

Bottom rest 16 is similarly constructed of a bottom support such as bottom pad 40 and spaced apart support members 42 to which pad 40 is attached, as shown in FIGS. 1–3. Bottom pad 40 and support members 42 are of similar construction to back pad 34 and support members 36. Bottom rest 16 is pivotally connected to the support members 36 and hence to back rest 14 at pivot 44. Pivot 44 is spaced apart from pivot 38.

The frame assembly 12 further comprises a back rest strut assembly 46 having a first end connected to the back rest 14 at pivot 48. Back rest strut assembly 46 has a second end connected to the base frame 18 at pivot 50 of extensions 52. The back rest strut assembly 46 of the preferred embodiment further includes telescoping inner tube 54, outer tube 56, and locking mechanism 58, such as of the spring-loaded pin type. As shown in FIGS. 2 and 3, inner tube 54 has holes therethrough to enable locking engagement with the pin of locking mechanism 58. One skilled in the art will appreciate that if back rest 14 does not have stop post 39, the back rest strut assembly 46 could be adapted to provide for further contraction resulting in a decline position of back rest 14.

Figure 5:
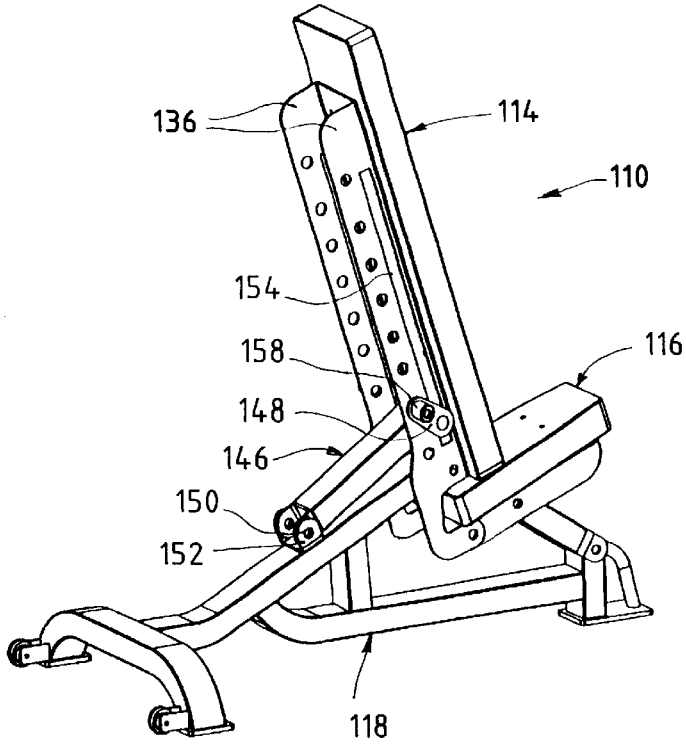
FIG. 5 is a front perspective view of an alternative embodiment of a multi-adjustable exercise bench of the present invention with the back rest in an upright position.
Figure 6:
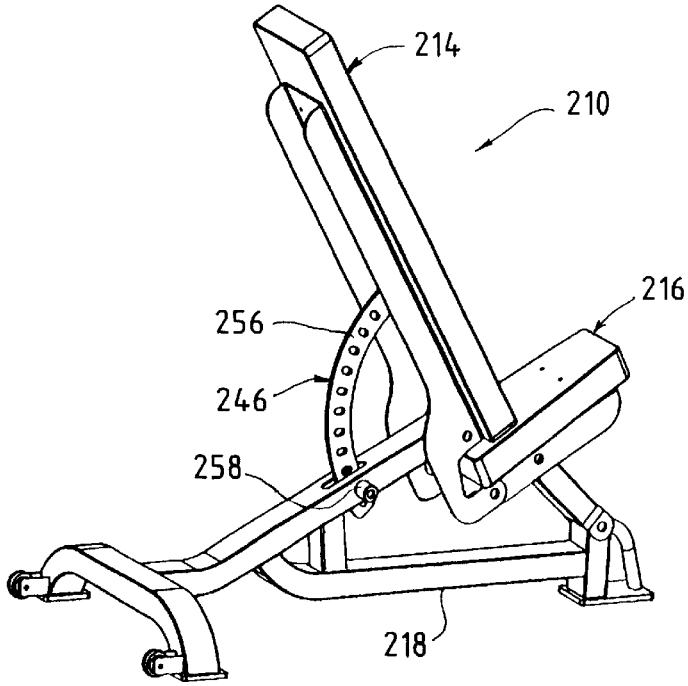
FIG. 6 is a front perspective view of a second alternative embodiment of a multi-adjustable exercise bench of the present invention with the back rest in an upright position.

The back rest strut assembly could be of further different construction. For example FIGS. 5 and 6 illustrate alternative embodiments having different back rest strut constructions. FIG. 5 shows a bench 110 having a back rest strut assembly 146 at its first end to the back rest 114 at releasable sliding mechanism 148, and connected at its second end to the base frame 118 at pivot 150 of extension bracket 152. Releasable sliding mechanism 148 slidingly engages slots 154 in back rest support members 136. The back rest strut assembly 146 of the alternative embodiment of FIG. 5 is of fixed length and further includes a locking mechanism 158 which engages adjustment holes through back rest support members 136 for selective adjustment of the angle of back rest 114 relative to a bench supporting surface.

FIG. 6 shows a further example of an alternative embodiment with bench 210 having a back rest strut assembly 246 having an arcuate strut 256. Arcuate strut 256 has holes therethrough. Strut assembly 246 is fixedly connected at its first end to the back rest 214 and releasably connected at its second end to the base frame 218 where locking mechanism 258 engages the holes through arcuate strut 256. The arcuate strut 256 of back rest strut assembly 246 is of fixed length, however, its effective length varies depending on which hole along the arcuate strut 256 is engaged by locking mechanism 258. In this manner, the alternative embodiment of FIG. 6 provides for selective adjustment of the angle of back rest 214 relative to a bench supporting surface.

Returning to FIGS. 1 through 3, the frame assembly 12 also includes a bottom rest strut assembly 60. Bottom rest strut assembly 60 is connected at its first end to the bottom rest 16 at pivot 62, and is connected at its second end to the base frame 18 at pivot 64. Bottom rest strut assembly 60 further comprises strut tube 66.

As shown in FIG. 4 (FIGS. 4A through 4D), a bench embodying the present invention yields significant advantages over the prior art. The angle of the back rest 14 relative to the bench supporting surface may be adjusted by releasing locking mechanism 58, sliding outer tube 56 to a new position of alignment between locking mechanism 58 and a hole through inner tube 54, and reengaging locking mechanism 58. Adjustment of the angle of the back rest 14 simultaneously causes the bottom rest 16 to adjust to a more appropriate angle relative to the back rest 14 and to the bench supporting surface.

As shown in FIG. 4, the displacement between pivots 38 and 44 causes the bottom rest 16 to nest within the contours of back rest support members 36. These pivots, in conjunction with the bottom rest strut assembly 60 and the location of its respective pivots 62 and 64, also cause the bottom rest 16 to move closer to the bench supporting surface as the back rest 14 is adjusted to a more upright position. This is readily apparent when one views the distance between a bench supporting surface (as it would be contacted by support members 26 and 28) and pivot 44 on bottom rest 16 as the bench 10 is adjusted from the horizontal position in FIG. 4A to the substantially upright position in FIG. 4D. The movement of the bottom rest 16 closer to the bench supporting surface as bench 10 is adjusted to a more upright position improves the comfort to the user and reduces the tendency of the user to hyperextend the user's lower back.

Although reference has been made, for the purpose of explanation, to the use of the present invention automatically to provide preferred back rest to bottom rest angular relationships and single point, simultaneous back rest and bottom rest adjustment, it is understood that additional benefits may be achieved through use of the invention. Also, it should be understood that any of a variety of fastening mechanisms and suitable materials of construction and dimensions may be used to satisfy the particular needs and requirements of the end user. It will be apparent to those skilled in the art that modifications and variations can be made in the design and construction of the multi-adjustable exercise bench without departing from the scope or spirit of the invention. Other embodiments of the invention will be apparent to those skilled in the art from consideration of the specification and practice of the invention disclosed herein.

What is claimed is:

1. A multi-adjustable exercise bench comprising:

a frame assembly;

a back rest pivotally connected to said frame assembly;

a bottom rest pivotally connected at a first pivot to said back rest via a single pivot axis at a location spaced apart from said pivotal connection of said back rest to said frame assembly and said bottom rest pivotally connected at a second pivot to said frame assembly;

said frame assembly further comprising a base frame and a first strut;

said first strut connected to said back rest and to said base frame and adapted to support said back rest in a plurality of different positions defined by the angle of said back rest relative to a bench supporting surface; and wherein said first strut to back rest connection moves further from said bench supporting surface as said back rest is increasingly inclined relative to said bench supporting surface.

2. A multi-adjustable exercise bench in accordance with claim 1, wherein said frame assembly further comprises a second strut, said second strut connected to said bottom rest and connected to said base frame.

3. A multi-adjustable exercise bench in accordance with claim 2, wherein said second strut is pivotally connected to said bottom rest and said second strut is pivotally connected to said base frame.

4. A multi-adjustable exercise bench in accordance with claim 1, wherein said first strut is pivotally connected to said back rest and said first strut is pivotally connected to said base frame.

5. A multi-adjustable exercise bench in accordance with claim 1, wherein said first strut is non-pivotally mounted to said back rest and said first strut is releasably connected to said base frame.

6. A multi-adjustable exercise bench in accordance with claim 1, wherein said first strut is of fixed length.

7. A multi-adjustable exercise bench in accordance with claim 1, wherein said first strut has two ends and one of said ends is pivotally mounted and the other of said ends is operatively connected in releasable sliding engagement.

8. A multi-adjustable exercise bench in accordance with claim 1, wherein said first strut is adjustable in length.

9. A multi-adjustable exercise bench in accordance with claim 8, wherein said first strut further comprises a telescoping tube assembly.

10. A multi-adjustable exercise bench in accordance with claim 9, wherein said telescoping tube assembly further comprises a locking mechanism to releasably fix the length of said first strut.

11. A multi-adjustable exercise bench in accordance with claim 1, wherein said first strut has at least one adjustable length whereby said back rest and bottom rest are substantially in the same plane.

12. A multi-adjustable exercise bench in accordance with claim 1, wherein said first strut has at least one adjustable length whereby said back rest and bottom rest are substantially perpendicular to each other.

13. A multi-adjustable exercise bench in accordance with claim 1, wherein said first strut has a plurality of adjustable length positions wherein the angle of each of said back rest and said bottom rest relative to said bench supporting surface changes with adjustment of the length of said first strut.

14. A multi-adjustable exercise bench in accordance with claim 1, wherein said bottom rest has a first end and a second end, said bottom rest being pivotally connected to said back rest proximate said first end of said bottom rest.

15. A multi-adjustable exercise bench in accordance with claim 14, wherein said first end of said bottom rest moves closer to said bench supporting surface as said back rest is increasingly inclined relative to said bench supporting surface.

16. A multi-adjustable exercise bench comprising:

a frame;

a back rest pivotally connected to said frame;

a bottom rest pivotally connected to said back rest via a single pivot axis at a location spaced apart from said pivotal connection of said back rest to said frame;

a first strut pivotally connected to said frame and connected to said back rest; and a second strut pivotally connected to said frame and pivotally connected to said bottom rest.

17. A multi-adjustable exercise bench in accordance with claim 16, wherein said back rest further comprises at least one support member having separate locations for connection to said frame, said bottom rest and said first strut.

18. A multi-adjustable exercise bench in accordance with claim 17, wherein said connection of said back rest support to said frame is located between said connection of said back rest support to said bottom rest and said connection of said back rest support to said first strut.

19. A multi-adjustable exercise bench in accordance with claim 16, wherein said first strut is pivotally connected to said back rest.

20. A multi-adjustable exercise bench in accordance with claim 16, wherein said first strut is non-pivotally mounted to said back rest.

21. A multi-adjustable exercise bench in accordance with claim 16, wherein said first strut is operatively connected to said back rest in releasable sliding engagement.

22. A multi-adjustable exercise bench in accordance with claim 16, wherein said first strut is adjustable in length.

23. A multi-adjustable exercise bench in accordance with claim 16, wherein said first strut has a plurality of adjustable length positions wherein the angle of each of said back rest and said bottom rest relative to said bench supporting surface changes with adjustment of the length of said first strut.

24. A multi-adjustable exercise bench in accordance with claim 16, wherein said bottom rest has a first end and a second end, said bottom rest being pivotally connected to said back rest proximate said first end of said bottom rest.

25. A multi-adjustable exercise bench in accordance with claim 24, wherein said first end of said bottom rest moves closer to said bench supporting surface as said back rest is increasingly inclined relative to said bench supporting surface.

26. A multi-adjustable exercise bench comprising:

a frame;

a back rest pivotally connected to said frame;

a bottom rest pivotally connected to said back rest via a single pivot axis at a location spaced apart from said pivotal connection of said back rest to said frame;

a first strut connected to said frame and connected to said back rest, said first strut adapted to support said back rest in a plurality of different positions defined by the angle of said back rest relative to a bench supporting surface; and wherein movement of said back rest between said positions automatically adjusts the angle of said back rest and the angle of said bottom rest relative to said bench supporting surface and said first strut to back rest connection moves further from said bench supporting surface as said back rest is increasingly inclined relative to said bench supporting surface.

27. A multi-adjustable exercise bench in accordance with claim 26, wherein said first strut is adjustable in length.

28. A multi-adjustable exercise bench in accordance with claim 26, wherein said frame assembly further comprises a second strut, said second strut connected to said bottom rest and connected to said base frame.

29. A multi-adjustable exercise bench in accordance with claim 28, wherein said second strut is pivotally connected to said bottom rest and said second strut is pivotally connected to said base frame.

30. A multi-adjustable exercise bench in accordance with claim 26, wherein said first strut is pivotally connected to said back rest.

31. A multi-adjustable exercise bench in accordance with claim 26, wherein said first strut is non-pivotally mounted to said back rest.

32. A multi-adjustable exercise bench in accordance with claim 26, wherein said first strut is operatively connected to said back rest in releasable sliding engagement.

33. A multi-adjustable exercise bench in accordance with claim 26, wherein said first strut is adjustable in length.

34. A multi-adjustable exercise bench in accordance with claim 33, wherein said first strut further comprises a telescoping tube assembly.

35. A multi-adjustable exercise bench in accordance with claim 34, wherein said telescoping tube assembly further comprises a locking mechanism to releasably fix the length of said first strut.

36. A multi-adjustable exercise bench in accordance with claim 26, wherein said bottom rest has a first end and a second end, said bottom rest being pivotally connected to said back rest proximate said first end of said bottom rest.

37. A multi-adjustable exercise bench in accordance with claim 36, wherein said first end of said bottom rest moves closer to said bench supporting surface as said back rest is increasingly inclined relative to said bench supporting surface.

* * * * *